United States Patent [19]

Parker

[11] 3,942,384

[45] Mar. 9, 1976

[54] SWASHPLATE MACHINES

[75] Inventor: Alfred Parker, Auckland, New Zealand

[73] Assignee: Parker Swashplate Limited, Auckland, New Zealand

[22] Filed: Sept. 17, 1974

[21] Appl. No.: 506,856

[30] Foreign Application Priority Data

Sept. 17, 1973 New Zealand ..... 171986

[52] U.S. Cl. ..... 74/60; 417/269; 418/53

[51] Int. Cl.[2] ..... F16H 23/00

[58] Field of Search ..... 74/60; 417/269; 418/50–53

[56] References Cited

UNITED STATES PATENTS 1,946,344 2/1934 Wicha ..... 74/60

1,984,447 12/1934 Wicha ..... 418/53

FOREIGN PATENTS OR APPLICATIONS 988,282 4/1965 United Kingdom

*Primary Examiner*—Kenneth W. Sprague
*Assistant Examiner*—James C. Yeung
*Attorney, Agent, or Firm*—Holman & Stern

[57] ABSTRACT

A Swashplate Machine having a non rotatable swash plate mounted so that rotation of a shaft causes oscillation of the swash plate and one or more baffles mounted in slots in the swash plate dividing the swash plate into portions which oscillate to cause the volume of chambers to vary.

8 Claims, 6 Drawing Figures

SWASHPLATE MACHINES

FIELD OF THE INVENTION

This invention relates to swashplate machines.

BACKGROUND OF THE INVENTION

Swash plate engines and pumps have been devised in the past in which pistons are disposed in cylinders placed parallel to the axis of the shaft of the engine but at a distance therefrom, the pistons driving the swash plate mechanism to rotate the shaft. This construction has the disadvantage of a multiplicity of parts so that the engine has few if any advantages over an ordinary crankshaft engine.

It is, therefore, an object of the present invention to provide a swash plate machine which will obviate or minimise the foregoing disadvantages in a simple yet effective manner or which will at least provide the public with a useful choice.

SUMMARY OF THE INVENTION

Accordingly the invention consists in a swash plate machine comprising a casing including two end members and a member or members providing curved surfaces, a shaft mounted in at least one of said end members, a non rotatable swash plate mounted in said casing, a bearing between said swash plate and part of said shaft, rotation of said part of said shaft causing oscillation of said swash plate within said casing, and one or more baffles and seals between said casing, said baffle and said swash plate, said baffle or baffles each operating in a slot in said swash plate so that the swash plate is divided into one or more portions, each portion oscillating in a chamber defined by two side walls of said baffle or baffles, a part of said curved surface of said casing, a surface of said swash plate, a surface of one of said end members, and one or more of said seals, the construction and arrangement being such that in use as said swash plate oscillates, it causes the volume of each said chamber to vary.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

One preferred form of the invention will now be described together with other embodiments of the invention, each other embodiment being shown in a preferred form with reference to the accompanying drawings in which,

DESCRIPTION OF PREFERRED EMBODIMENTS

Figure 1:
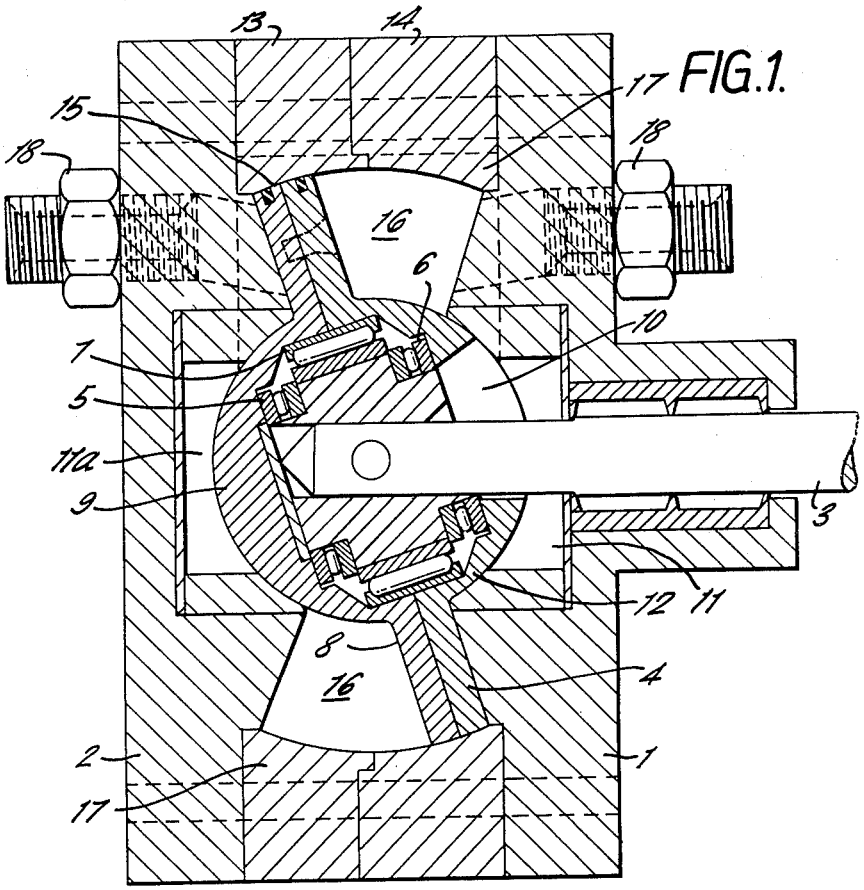
FIG. 1 is a transverse cross section through a swash plate machine according to the invention.

Referring to FIG. 1 of the drawings, a swash plate machine for use as a pump will be described.

In this construction, two end plates 1 & 2 are made, and the end plate 1 carries a shaft 3 mounted in suitable bearings, e.g., ball, but preferably roller bearings. The shaft 3 extends to a non rotating swash plate 4 mounting on an inner side of the end plate. The swash plate mounting includes bearings, e.g., thrust bearings 5 & 6 mounted at a suitable angle to the shaft and a further bearing 7. The swash plate 4 comprises, in addition to an annular disc 8, a spherical ball portion 9 having an aperture therein through which a part of the shaft projects. The thrust bearings 5 & 6 have the planes thereof lying parallel to the plane of the disc 8 of the swash plate and a cut out portion 10 of the spherical portion of the swash plate permits the swash plate to oscillate over an arc due to the angular mounting of the swash plate relative to the longitudinal axis of the shaft. The end plate 1 has a cylindrical hollow pad having a spherical depression on its face through which the shaft protrudes, and portions of the swash plate spherical part 9 bear against this surface to provide a seal. If desired additional resilient or spring loaded seals or other seals may be provided on this portion, for example, O rings could be provided adjacent the edge of the junction between the spherical portion and a flat portion of the end plate which is positioned just beyond the range of movement of the swash plate as it oscillates over its range of movements. Where seals run over flat or curved surfaces, the seals may comprise half cylinders having plane surfaces lying on a diametral line, such half cylinders carrying slots extending into the half cylinders from the plane surface, and such slots carrying spring loaded strip seals. These half cylinders then run in half cylindrical depressions in the surfaces of members where the seals are to be provided.

The further end plate 2 is formed in a similar manner, having a part spherical depression therein in which part of the ball 9 of the swash plate moves and, again, seals may be provided and the end plate also has flat portions positioned just beyond the range of movement of the disc portion of the swash plate.

These two end members are spaced apart from each other by further members having inner surfaces which are parts of spheres, and which will thus maintain substantially the same clearance from the edge 15 of the swash plate as it moves over the arc. These surfaces are, preferably, provided on a pair of curved wall casing parts, and the two end plates and these two casing parts form the casing of the engine.

To provide chambers in which parts of the swash plate can move to give either a pumping action or to enable a motor action by the two or four stroke combustion engine cycles operate, baffles 16 are provided comprising plates inserted in slots 17 in the casing and as shown the plates or baffles 16 lie opposite each other on either side of the axis 17 of the shaft 3 and lie on a diametral plane running through that axis. However, only one baffle 16 may be provided if desired. If two baffles 16 are provided then there are four pumping chambers, two on each side of the disc 8. Of course if only one baffle 16 is provided then there are only two chambers one on either side of the swash plate 4 i.e. on either side of the annular disc 8. An inlet and an outlet is provided to each pumping chamber and as shown connections 18 are provided which in the case of the double baffle would be duplicated in the lower part of FIG. 1 and such duplication has been omitted for clarity.

In the form shown in FIG. 1 as the shaft 3 is rotated the swash plate 4 oscillates in the chambers defined by walls of the baffles 16 adjacent walls of the casing and by movement of the swash plate 4 in these chambers. in this way a pumping action is given and by the addition of suitable valve mechanism an engine action could be given.

Figure 2:
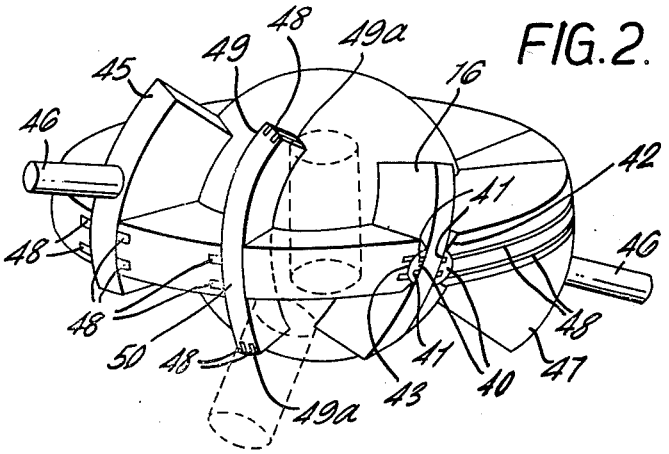
FIG. 2 is a perspective sketch of swash plate machine parts showing baffles and seals.

Referring to FIG. 2 seals 41 are shown in half trunnions 40 placed between the swash plate ring 8 and the baffle 16. As may be seen in this Figure, the edges 42 of the swash plate ring 8 are cut away to allow movement of the swash plate ring around adjacent the baffle and the seals 41 are mounted in depressions 43, the surfaces of which lie on a cylinder so that rotation of the ring 8 relative to the baffle 16 still permits sealing. The seals 41 may comprise, for example, shaped pieces of PTFE or any other suitable material. Additional seals 48 may be inserted if it is felt that these are required.

The construction shown in FIG. 2 also illustrates an additional and different type of baffle comprising baffle plates 45 which are mounted on pivots 46, the pivots 46 oscillating in bearings in the casing (not shown in FIG. 2 for clarity) of the pump or engine. Seals e.g. seals 48 are provided as necessary between adjacent moving surfaces and surfaces 49a are curved to give clearance.

Although four baffles have been above described, it is clear that other numbers of baffles may be provided depending on the purposes to which the machine is to be put in use, in which event some of the baffles are freely mounted. Thus in FIG. 2 baffles such as baffle 49 are freely mounted in the casing being retained in a slot 50 the walls of the slot maintaining the baffle 49 at the appropriate angle e.g. right angles to the swash plate 8.

The inter-engagement of the fixed baffles 16 with the slots in the swash plate will prevent the swash plate from rotating. If now, the shaft is rotated, the pressure on the thrust bearing will cause the swash plate to oscillate. and as a result, in each chamber on each side of the part of the swash plate in that chamber, there will be a variation in the volume between the swash plate disc and the walls of the casing on that side of the swash plate.

In one example above quoted, there are, therefore eight chambers four on each side of the swash plate — and these chambers may be used for pumping or for prime mover purposes. Because the baffles are sealed against the parts with which it engages, such as the interior of the casing, the exterior of the ball portion of the swash plate mechanism and the swash plate itself, and the result is that oscillation of the swash plate will cause rotary motion of the shaft, the shaft being mounted in suitable bearings.

Figure 3:
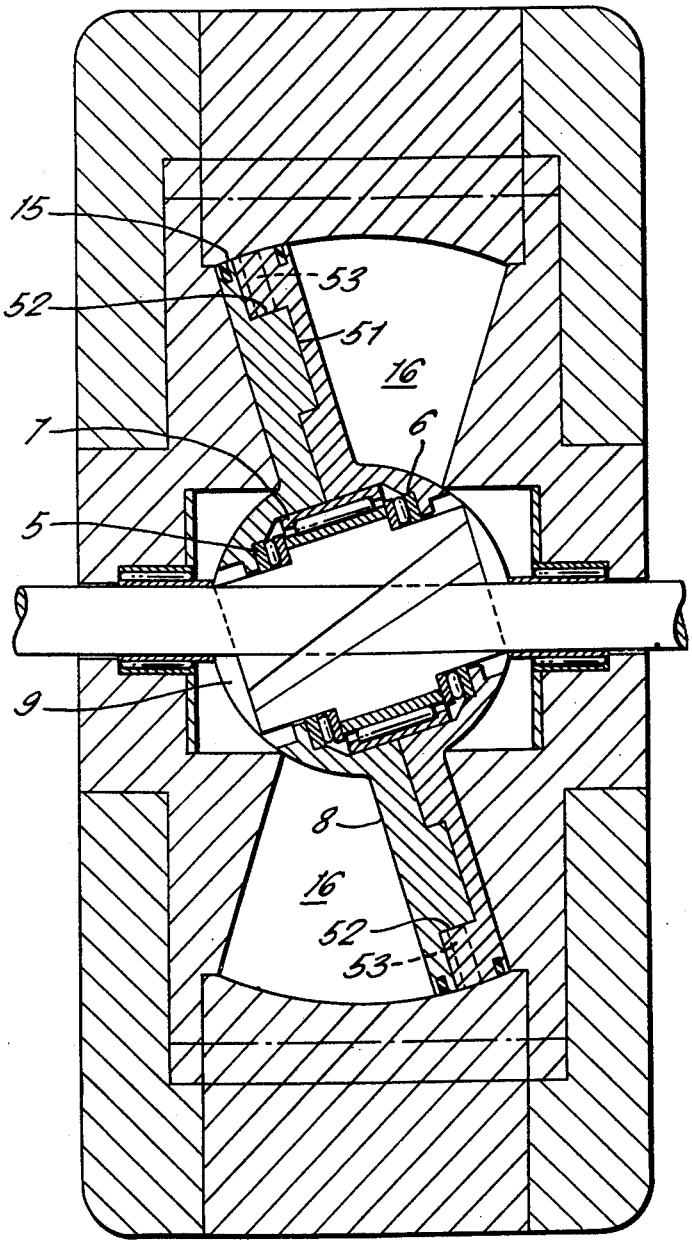
FIG. 3 is a diagrammatic cross section of a swash plate machine showing a swash plate assembly arrangement.
Figure 4:
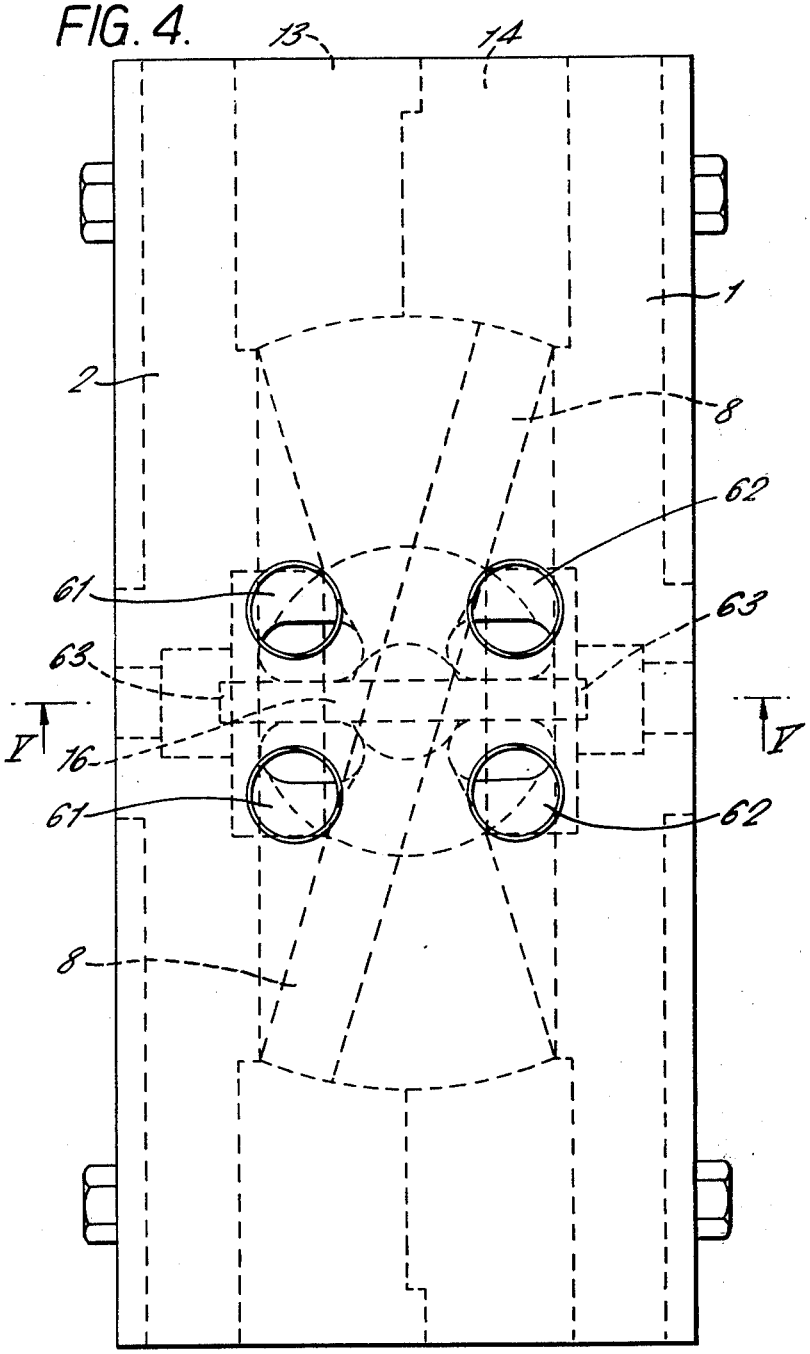
FIG. 4 is a plan view of a pump according to the invention, and, FIG. 5 is a further diagrammatic cross section on the line V—V FIG. 4 and, FIG. 6 is a longitudinal diagrammatic cross section of a modified machine showing water cooling.
Figure 5:
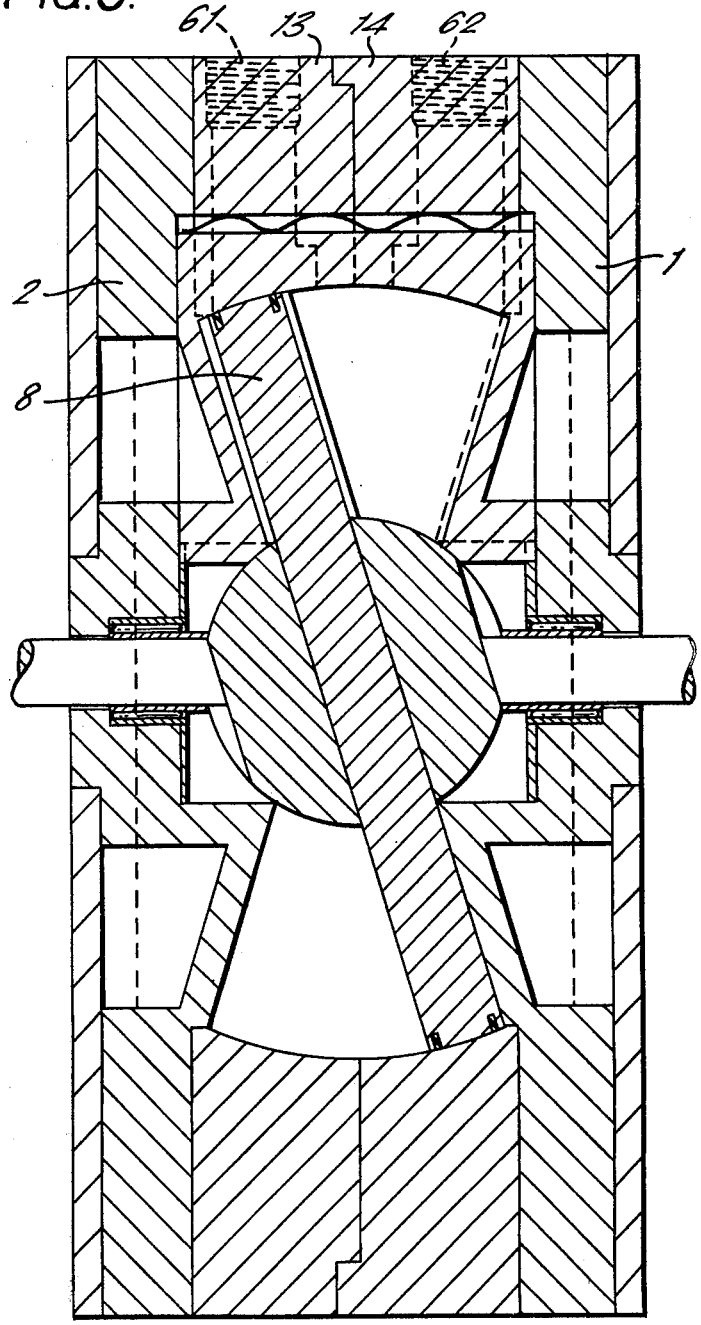

Referring now to FIGS. 3 to 5 the constructions shown in these Figures are similar to that described in FIG. 1 and similar parts have similar reference numbers. In FIG. 3 the swash plate 8 is provided in two parts having a zig zag joint line 51 with mating surfaces 52 arranged so that screws 53 may be inserted to hold the parts together. This enables the operating faces of the swash plate to have plane surfaces. In FIG. 4 and FIG. 5 may be seen a different arrangement of inlet and outlet connections for a pump, thus in the arrangement shown since there is only one baffle 16 there are accordingly two pumping chambers each having an inlet 61 and an outlet 62, these being disposed adjacent the baffle 16. In this view it may be seen that the baffle 16 is engaged in recess 63 in the casing parts 1 and 2.

From the foregoing it will be seen that a basic motion for a swash plate engine or pump is achieved in a simple yet effective manner. The ancillary equipment will depend on the end use, thus, for an internal combustion engine valving or porting means will be provided to give either a two stroke or four stroke cycle, and for the two stroke cycle, for example, a chamber on one side of the swash plate will be used to compress an inlet charge and transfer port arranged to transfer this compressed charge over into the firing chamber on the opposite side of the swash plate where a sparking plug will be fitted to fire the mixture at the appropriate time.

The advantages of this construction are considerable, and the moving parts are kept to a minimum with a consequent reduction in cost. The machining is to spherical or other simple geometric forms, which can be readily machined under production conditions. The engine is compact thus little space is taken up by the arrangement.

Cooling of the swash plate may be effected by providing inlet and outlet connections in the spherical depression in the end plate not carrying the shaft and these communicate with ducts in the spherical portion of the swash plate which ducts, in turn, lead to the disc portion of the swash plate.

Lubrication and sealing are readily effected. In some cases, the seals may be rings or strips let in the edge of the swash plate, e.g., adjacent the slots in which the baffles are positioned and, if desired, continuous rings may be provided around the edge of the swash plate to bear against the curved portions of the casing parts, and the seals against the baffles may overlap the end seals if desired.

Figure 6:
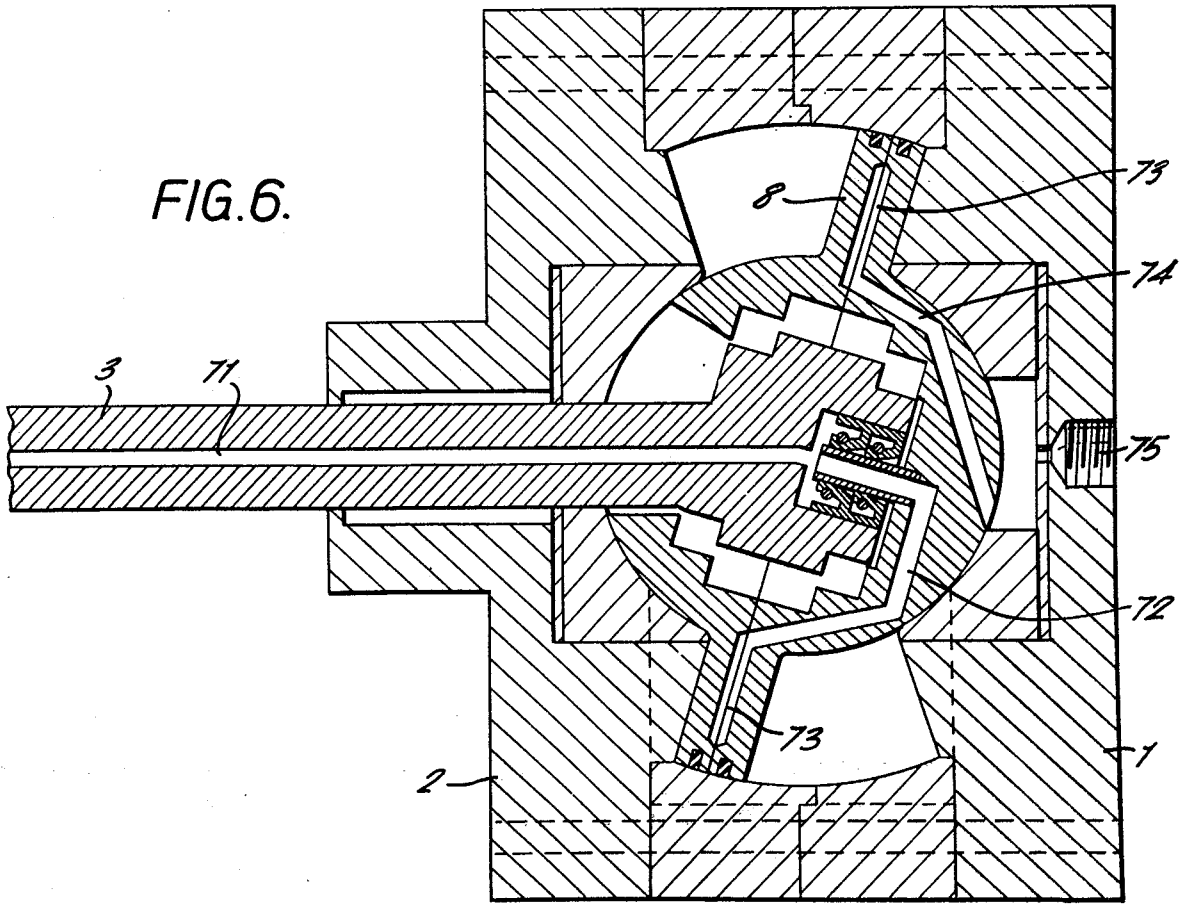

In FIG. 6 a cooling passageway 71 in the shaft 3 connects through conduit 72 with an annular conduit 73 and then with conduit 74 to pass to outlet 75 for the purpose of enabling a cooling fluid e.g. water to be passed through the shaft and swash plate for cooling purposes. The body or casing may also be provided with cooling passageways.

I believe the engine has the following advantages:

1. a very compact engine is provided.
2. very low dynamic loads result from the arrangement of the mechanism,
3. the components move only over a low total movement and there is, therefore, less movement than in normal engines and consequently, less wear,
4. there is ample room for multiple sealing grids or strips if required,
5. the surface velocity of the sealing grids or strips is low,
6. most of the sealing grids or strips are not loaded except by gas pressure,
7. sealing grids have constant geometric clearance from the surfaces with which they engage,
8. because of low speeds and low loads on working surfaces, the life of the engine is likely to be greater than any other engine of equivalent output,
9. there are only two main bearings, and these may be needles, rollers or ball or plain bearings, as desired,
10. a high compression ratio engine is possible both as a four or an eight chamber model, and the compression ratio of up to 19:1 is possible on an eight chamber motor as above described in the preferred form, 11, the total number of major parts which may amount to 42 on a normal V8 engine amounts to only 13 on the swash plate eight chamber engine as described in the form of FIG. 2, 12. high load is limited to two reaction surfaces only, 13. the engine is balanced except for a small rocking couple, 14. all surfaces exposed to the flame of combustion if an engine is being used can be water cooled, including the swash plate surfaces themselves, 15. the single high speed swash plate edge is not loaded in any way except by ring pressure and all other sealing surfaces are of low speed, 16. positive displacement of nearly any fluid (Gas or Liquid)

17. easily made on simple machine tools, 18. high capacity to bulk ratio 19. constant flow characteristics, therefor no inertia losses, 20. design lends itself well to mass production methods, 21. very wide range of materials suitable, 22. extremely low dynamic loads, 23. can be made as a motor or pump, 24. range of sizes wide (From dentists drill size to 100 ft. diameter)

25. high volumetric efficiency 26. high rotation speeds possible, 27. can be made to deliver oil free air to B.S.S.

28. materials may be selected for end use, 29. easily assembled and dismantled, 30. adjustable for wear, 31. likely to be very long lived indeed.

I claim:

1. A swash plate machine comprising a casing including two end members and at least one member providing curved surfaces, a shaft mounted in at least one of said end members, a swash plate non-rotatably mounted in said casing, a bearing between said swash plate and part of said shaft so arranged that rotation of said part of said shaft causes oscillation of said swash plate within said casing, and at least one substantially parallel sided baffle, and seals between said casing, said baffle and said swash plate, said baffle operating in a slot in said swash plate so that the swash plate is divided into portions, each portion oscillating in a chamber defined by two side walls of said baffle, a part of said curved surface of said casing, a surface of said swash plate, a surface of one of said end members, and said seals, said swash plate when oscillating forming variable-volume chambers, at least one baffle being fixed at the edges in said casing and operating in a slot in said swash plate, the walls defining said slot on each side having a cylindrically-shaped central depression flanked on either side by bevelled faces with trunnions having cylindrical surfaces on one side of each shaped to engage said cylindrically-shaped central depression.

2. A swash plate machine as claimed in claim 1 wherein said one baffle is provided fixed at the edges in said casing.

3. A swash plate as claimed in claim 1 wherein two baffles are provided fixed at the edges of said casing so as to lie substantially in the same plane and on opposite sides of said shaft.

4. A swash plate machine as claimed in claim 3 wherein two further baffles are provided pivotally mounted in said casing and disposed symmetrically between said fixed baffles.

5. A swash plate machine as claimed in claim 1 wherein seals are provided between relatively moving parts.

6. A swash Plate machine as claimed in claim 5 wherein the walls defining each said slot in said swash plate are cylindrical and a part trunnion engages said walls and said swash plate.

7. A swash plate machine as claimed in claim 1 wherein said swash plate has a spherically contoured central portion and said baffle is contoured to fit against said central portion.

8. A swash plate machine as claimed in claim 7 wherein said end members have walls defining spherically contoured depressions which bear against said central portion of said swash plate.

* * * * *